US010885862B2

(12) United States Patent
Zhang et al.

(10) Patent No.: US 10,885,862 B2
(45) Date of Patent: Jan. 5, 2021

(54) GOA CIRCUIT, DISPLAY PANEL AND DISPLAY APPARATUS

(71) Applicant: WUHAN CHINA STAR OPTOELECTRONICS TECHNOLOGY CO., LTD, Wuhan (CN)

(72) Inventors: Xin Zhang, Wuhan (CN); Juncheng Xiao, Wuhan (CN); Chao Tian, Wuhan (CN); Yanqing Guan, Wuhan (CN)

( * ) Notice: Subject to any disclaimer, the term of this patent is extended or adjusted under 35 U.S.C. 154(b) by 63 days.

(21) Appl. No.: 16/342,207

(22) PCT Filed: Aug. 16, 2018

(86) PCT No.: PCT/CN2018/100762

§ 371 (c)(1),
(2) Date: Apr. 16, 2019

(87) PCT Pub. No.: WO2020/019379

PCT Pub. Date: Jan. 30, 2020

(65) Prior Publication Data

US 2020/0226993 A1 Jul. 16, 2020

(30) Foreign Application Priority Data

Jul. 26, 2018 (CN) ..... 2018 1 0835140

(51) Int. Cl.
*G09G 3/36* (2006.01)

(52) U.S. Cl.
CPC ..... *G09G 3/3677* (2013.01); *G09G 3/3696* (2013.01); *G09G 2310/0283* (2013.01); *G09G 2320/0204* (2013.01)

(58) Field of Classification Search
None
See application file for complete search history.

(56) References Cited

U.S. PATENT DOCUMENTS

| | | | | |
|---|---|---|---|---|
| 9,535,275 | B2 | 1/2017 | Xu | |
| 2017/0162148 | A1* | 6/2017 | Xiao | G09G 3/3674 |
| 2018/0040600 | A1* | 2/2018 | Li | G09G 3/3674 |

FOREIGN PATENT DOCUMENTS

| | | | |
|---|---|---|---|
| CN | 106782389 | A | 5/2017 |
| CN | 108010495 | A | 5/2018 |

* cited by examiner

*Primary Examiner* — Carl Adams

(57) ABSTRACT

A GOA circuit, a display panel and a display apparatus are provided. The GOA circuit includes: a forward/backward scanning control module configured to control, according to a forward scanning control signal or a backward scanning control signal, the GOA circuit to perform forward scanning or backward scanning, the level of an output signal from the forward/backward scanning control module being greater than a preset value; and, an output control module configured to control, according to a clock signal in a current level, the output of a gate driving signal in the current level.

19 Claims, 4 Drawing Sheets

GOA CIRCUIT, DISPLAY PANEL AND DISPLAY APPARATUS

FIELD OF THE INVENTION

The present disclosure relates to the technical field of display, and more particularly to a GOA circuit, a display panel, and a display apparatus.

DESCRIPTION OF THE RELATED ART

At present, liquid crystal display devices have been widely applied to various electronic products. As an important part of the liquid crystal display devices, a Gate Driver On Array (GOA) circuit is a technology for fabricating a gate line scanning driving signal circuit on an array substrate by an existing TFT-LCD array process flow to realize driving for line-by-line scanning of the gate.

Display panels based on Low Temperature Polycrystalline Silicon (LTPS) may include NMOS display panels, PMOS display panels, and CMOS display panels having both NMOS TFTs and PMOS TFTs, depending on the type of Thin Film Transistors (TFTs) used in display panels. Similarly, GOA circuits include NMOS circuits, PMOS circuits and CMOS circuits. Compared with the CMOS circuits, the NMOS circuits have increased product yield and reduced cost due to the omitted P-doped mask and corresponding procedures. In the NMOS TFTs, the carriers are electrons, with high mobility. But, it is easier for NMOS devices to be damaged than PMOS devices (the carriers are holes), and it is likely to cause GOA failure and screen splitting in the panels due to insufficient high-temperature dependency. Particularly, for IN cell Touch Panels (ITPs), it is more likely to cause screen splitting in the suspend stage of the TPs.

In existing ITPs, it is usually required to insert several TP terms into one frame to realize a touch function. However, in the NMOS GOA circuits, the high potential required by hierarchical transmission is maintained by the capacitor at a node Q. TFTs are not ideal devices since there is still current leakage even if the TFTs are turned off. If each TP term is long, it is necessary to maintain the suspend stage of the TP in a high potential for a long period of time. Consequently, the stability of hierarchical transmission in GOA is reduced.

Hence, it is necessary to provide a GOA circuit, a display panel, and a display apparatus to overcome the problems existing in the conventional technology.

SUMMARY OF THE INVENTION

An objective of the present disclosure is to provide a GOA circuit, a display panel, and a display apparatus which can improve the stability of hierarchical transmission.

In order to solve the above technical problem, the present disclosure provides a GOA circuit, including:

m cascaded GOA units, wherein the GOA unit in an n-th level includes:

a forward/backward scanning control module, a node signal control module, an output control module, a first voltage stabilizer module, a first pull-down module, a second pull-down module and a third pull-down module, where $m \geq n \geq 1$;

the forward/backward scanning control module is configured to control, according to a forward scanning control signal or a backward scanning control signal, the GOA circuit to perform forward scanning or backward scanning, the level of an output signal from the forward/backward scanning control module being greater than a preset value;

the node signal control module is configured to control, according to a clock signal in an (n+1)th level and a clock signal in an (n−1)th level, the GOA circuit to output a low-potential gate driving signal in a non-operating stage;

the output control module is configured to control, according to a clock signal in a current level, the output of a gate driving signal in the current level;

the first voltage stabilizer module is configured to maintain the level of a first node;

the first pull-down module is configured to pull down the level of the first node;

the second pull-down module is configured to pull down the level of a second node; and the third pull-down module is configured to pull down the level of the gate driving signal in the current level, and includes a tenth thin film transistor having a gate connected to the second node, a constant-voltage low-potential signal being supplied to a source of the tenth thin film transistor;

wherein the forward scanning control module includes a first thin film transistor, a second thin film transistor, a fifteenth thin film transistor and a sixteenth thin film transistor;

a constant-voltage high-potential signal is supplied to a gate of the first thin film transistor, a forward DC scanning control signal is supplied to a source of the first thin film transistor, and a drain of the first thin film transistor is connected to a gate of the fifteenth thin film transistor; and, a gate driving signal from a GOA structure unit in an (N−2)th level is supplied to a source of the fifteenth thin film transistor, and a drain of the fifteenth thin film transistor is connected to a drain of the sixteenth thin film transistor, the second pull-down module and the first node, respectively; and a constant-voltage high-potential signal is supplied to a gate of the second thin film transistor, a backward DC scanning control signal is supplied to a source of the second thin film transistor is, and a drain of the second thin film transistor is connected to a gate of the sixteenth thin film transistor; and, a gate driving signal from a GOA structure unit in an (N+2)th level is supplied to a source of the sixteenth thin film transistor.

In the GOA circuit of the present disclosure, the GOA unit in the n-th level further comprises:

a second voltage stabilizer module, which is electrically connected to the forward/backward scanning control module and configured to maintain the level of the output signal from the forward/backward scanning control module.

In the GOA circuit of the present disclosure, the second voltage stabilizer module comprises a fourteenth thin film transistor, a gate of the fourteenth thin film transistor is connected to the drain of the fifteenth thin film transistor, a global signal is supplied to a source of the fourteenth thin film transistor, and a drain of the fourteenth thin film transistor is connected to the first node.

In the GOA circuit of the present disclosure, the second pull-down module comprises a sixth thin film transistor, a gate of the sixth thin film transistor is connected to the drain of the sixteenth thin film transistor, the constant-voltage low-potential signal is supplied to a source of the sixth thin film transistor, and a drain of the sixth thin film transistor is connected to the second node.

In the GOA circuit of the present disclosure, the GOA unit in the n-th level further comprises a charge storage module configured to store charge of a third node, wherein the third node is a connection point between the output control module and the first voltage stabilizer module.

In the GOA circuit of the present disclosure, the charge storage module comprises a first capacitor, one end of which is connected to the third node and the other end of which is connected to an output end of the output control module.

In the GOA circuit of the present disclosure, the output control module comprises a ninth thin film transistor, a gate of the ninth thin film transistor is connected to the third node, a clock signal in a current level is supplied to a source of the ninth thin film transistor, and a drain of the ninth thin film transistor is connected to the third pull-down module and the other end of the first capacitor, respectively.

In the GOA circuit of the present disclosure, the GOA unit in the n-th level further comprises a fourth pull-down module and a pull-up module;

the fourth pull-down module comprises a thirteenth thin film transistor, a second global signal is supplied to a gate of the thirteenth thin film transistor and the constant-voltage low-potential signal is supplied to a source of the thirteenth thin film transistor; and the pull-up module comprises an eleventh thin film transistor and a twelfth thin film transistor; a gate and a source of the eleventh thin film transistor are connected; a first global signal is supplied to a gate of the twelfth thin film transistor and the gate of the eleventh thin film transistor; a constant-voltage low-potential signal is supplied to a source of the twelfth thin film transistor, and a drain of the twelfth thin film transistor is connected to the second node; a drain of the eleventh thin film transistor is connected to the drain of the ninth thin film transistor, a drain of the tenth thin film transistor and a drain of the thirteenth thin film transistor.

In the GOA circuit of the present disclosure, the first pull-down module comprises a fifth thin film transistor having a gate connected to the second node; and a drain of the fifth thin film transistor is connected to the first node, and the constant-voltage low-potential signal is supplied to a source of the fifth thin film transistor.

The present disclosure further provides a liquid crystal panel having a GOA circuit. The GOA circuit includes m cascaded GOA units, wherein the GOA unit in an n-th level comprises:

a forward/backward scanning control module, a node signal control module, an output control module, a first voltage stabilizer module, a first pull-down module, a second pull-down module and a third pull-down module, where $m \geq n \geq 1$;

the forward/backward scanning control module is configured to control, according to a forward scanning control signal or a backward scanning control signal, the GOA circuit to perform forward scanning or backward scanning, the level of an output signal from the forward/backward scanning control module being greater than a preset value;

the node signal control module is configured to control, according to a clock signal in an (n+1)th level and a clock signal in an (n−1)th level, the GOA circuit to output a low-potential gate driving signal in a non-operating stage;

the output control module is configured to control, according to a clock signal in a current level, the output of a gate driving signal in the current level;

the first voltage stabilizer module is configured to maintain the level of a first node;

the first pull-down module is configured to pull down the level of the first node;

the second pull-down module is configured to pull down the level of a second node; and the third pull-down module is configured to pull down the level of the gate driving signal in the current level.

In the liquid crystal panel of the present disclosure, the forward scanning control module includes a first thin film transistor, a second thin film transistor, a fifteenth thin film transistor and a sixteenth thin film transistor;

a constant-voltage high-potential signal is supplied to a gate of the first thin film transistor, a forward DC scanning control signal is supplied to a source of the first thin film transistor, and a drain of the first thin film transistor is connected to a gate of the fifteenth thin film transistor; and, a gate driving signal from a GOA structure unit in an (N−2)th level is supplied to a source of the fifteenth thin film transistor, and a drain of the fifteenth thin film transistor is connected to a drain of the sixteenth thin film transistor, the second pull-down module and the first node, respectively; and a constant-voltage high-potential signal is supplied to a gate of the second thin film transistor, a backward DC scanning control signal is supplied to a source of the second thin film transistor, and a drain of the second thin film transistor is connected to a gate of the sixteenth thin film transistor; and, a gate driving signal from a GOA structure unit in an (N+2)th level is supplied to a source of the sixteenth thin film transistor.

In the liquid crystal panel of the present disclosure, the GOA unit in the n-th level further comprises:

a second voltage stabilizer module, which is electrically connected to the forward/backward scanning control module and configured to maintain the level of the output signal from the forward/backward scanning control module.

In the liquid crystal panel of the present disclosure, the second voltage stabilizer module comprises a fourteenth thin film transistor, a gate of the fourteenth thin film transistor is connected to the drain of the fifteenth thin film transistor, a global signal is supplied to a source of the fourteenth thin film transistor, and a drain of the fourteenth thin film transistor is connected to the first node.

In the liquid crystal panel of the present disclosure, the second pull-down module comprises a sixth thin film transistor, a gate of the sixth thin film transistor is connected to the drain of the sixteenth thin film transistor, the constant-voltage low-potential signal is supplied to a source of the sixth thin film transistor, and a drain of the sixth thin film transistor is connected to the second node.

In the liquid crystal panel of the present disclosure, the GOA unit in the n-th level further comprises a charge storage module configured to store charge of a third node, wherein the third node is a connection point between the output control module and the first voltage stabilizer module.

In the liquid crystal panel of the present disclosure, the charge storage module comprises a first capacitor, one end of which is connected to the third node and the other end of which is connected to an output end of the output control module.

In the liquid crystal panel of the present disclosure, the output control module comprises a ninth thin film transistor, a gate of the ninth thin film transistor is connected to the third node, a clock signal in a current level is supplied to a source of the ninth thin film transistor, and a drain of the ninth thin film transistor is connected to the third pull-down module and the other end of the first capacitor, respectively.

In the liquid crystal panel of the present disclosure, the third pull-down module includes a tenth thin film transistor having a gate connected to the second node, a constant-voltage low-potential signal being supplied to a source of the tenth thin film transistor.

In the liquid crystal panel of the present disclosure, the GOA unit in the n-th level further comprises a second capacitor, one end of the second capacitor is connected to the second node, and a constant-voltage low-potential signal is supplied to the other end of the second capacitor.

The present disclosure further provides a display apparatus that includes the aforementioned liquid crystal panel.

In the GOA circuit, the display panel and the display apparatus of the present disclosure, by improving the forward/backward scanning control module, the capability of inputting hierarchical transmission signals into the GOA circuit is improved and the threshold loss during the hierarchical transmission is avoided.

DETAILED DESCRIPTION OF THE PREFERRED EMBODIMENTS

Figure 1:
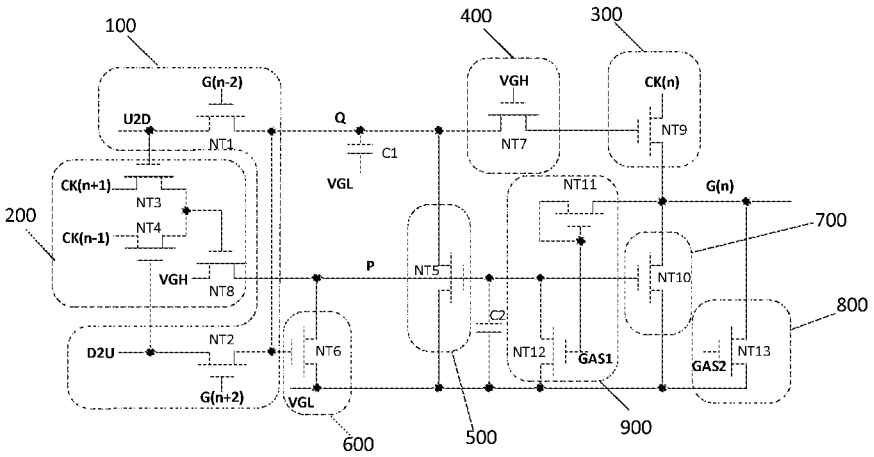
FIG. 1 (PRIOR ART)
FIG. 1 is a schematic structure diagram of an existing GOA circuit.

The foregoing objects, features and advantages adopted by the present disclosure can be best understood by referring to the following detailed description of the preferred embodiments and the accompanying drawings. Furthermore, the directional terms described in the present disclosure, such as upper, lower, front, rear, left, right, inner, outer, side, etc., are only directions referring to the accompanying drawings, so that the used directional terms are used to describe and understand the present disclosure, but the present disclosure is not limited thereto. In the drawings, similar structural units are designated by the same reference numerals.

As shown in FIG. 1, an existing GOA circuit includes m cascaded GOA units, and the GOA unit in an n-th level includes: a forward/backward scanning control module 100, a node signal control module 200, an output control module 300, a voltage stabilizer module 400, a first pull-down module 500, a second pull-down module 600, a third pull-down module 700, a fourth pull-down module 800, a pull-up module 900, a first capacitor C1 and a second capacitor C2, where $m \geq n \geq 1$.

The forward/backward scanning control module 100 is configured to control, according to a forward scanning control signal U2D or a backward scanning control signal D2U, the GOA circuit to perform forward scanning or backward scanning. The node signal control module 200 is configured to control, according to a clock signal CK(n+1) in an (n+1)th level and a clock signal CK(n−1) in an (n−1)th level, the GOA unit in a current level to output a low-potential gate driving signal in a non-operating stage. The output control module 300 is configured to control, according to a clock signal CK(n) in the current level, the output of a gate driving signal in the current level. The voltage stabilizer module 400 is configured to maintain the level of a first node Q. The first pull-down module 500 is configured to pull down the level of the first node Q. The second pull-down module 600 is configured to pull down the level of a second node P. The third pull-down module 700 is configured to pull down the level of the gate driving signal G(n) in the current level. The fourth pull-down module 800 is configured to pull down, according to a second global signal GAS2, the level of the gate driving signal G(n) in the current level when a display panel is in a second operating state. The pull-up module 900 is configured to control, according to a first global signal GAS1, the GOA unit in the current level to output a high-level gate driving signal when the display panel is in a first operating state. The first operating state occurs during black-screen touch operation or during abnormal power-off. It should be understood that, when the display panel is in the first operating state, the first global signal GAS1 is in a high level, and all GOA units output high-level gate driving signals. The second operating state occurs during display touch operation. In this case, the second global signal GAS2 is in a high level.

When the display panel is in a forward scanning state, the U2D is in a high level while the D2U is in a low level. In this case, the GOA circuit performs line-by-line scanning from the top down. On the contrary, when the display panel is in a backward scanning state, the U2D is in a low level while the D2U is in a high level. In this case, the GOA circuit performs line-by-line scanning from the bottom up.

Figure 2:
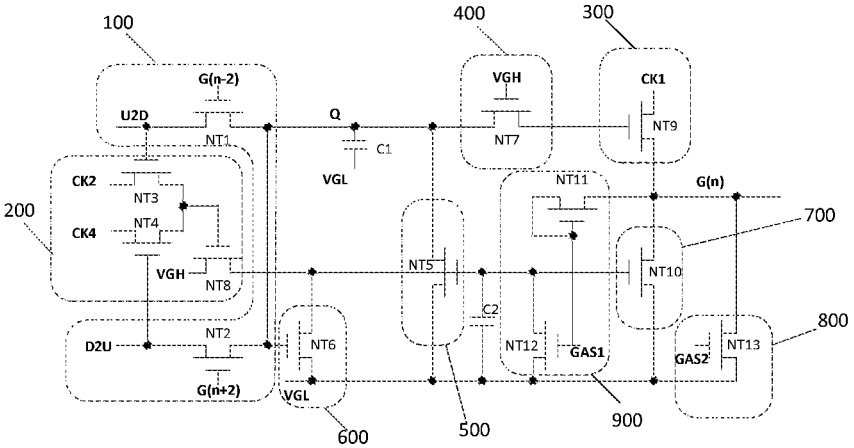
FIG. 2 (PRIOR ART)
FIG. 2 is a schematic structure diagram of a GOA unit in an n-th level in the existing GOA circuit.
Figure 3:
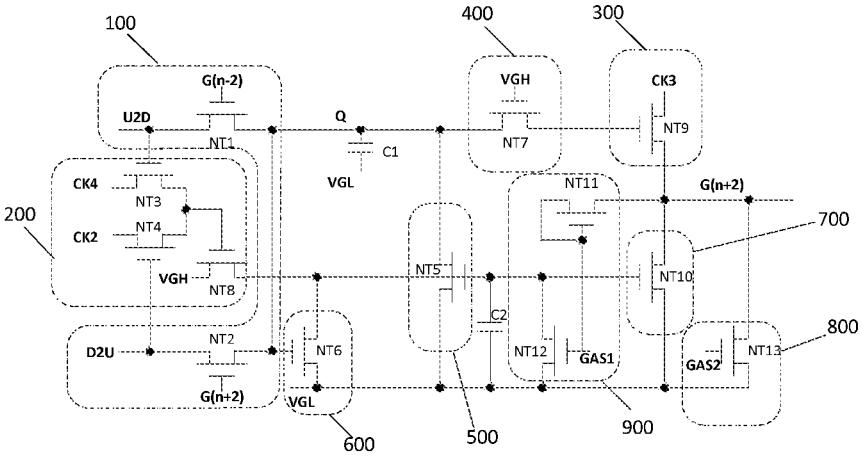
FIG. 3 (PRIOR ART)
FIG. 3 is a schematic structure diagram of a GOA unit in an (N+2)th level in the existing GOA circuit.
Figure 4:
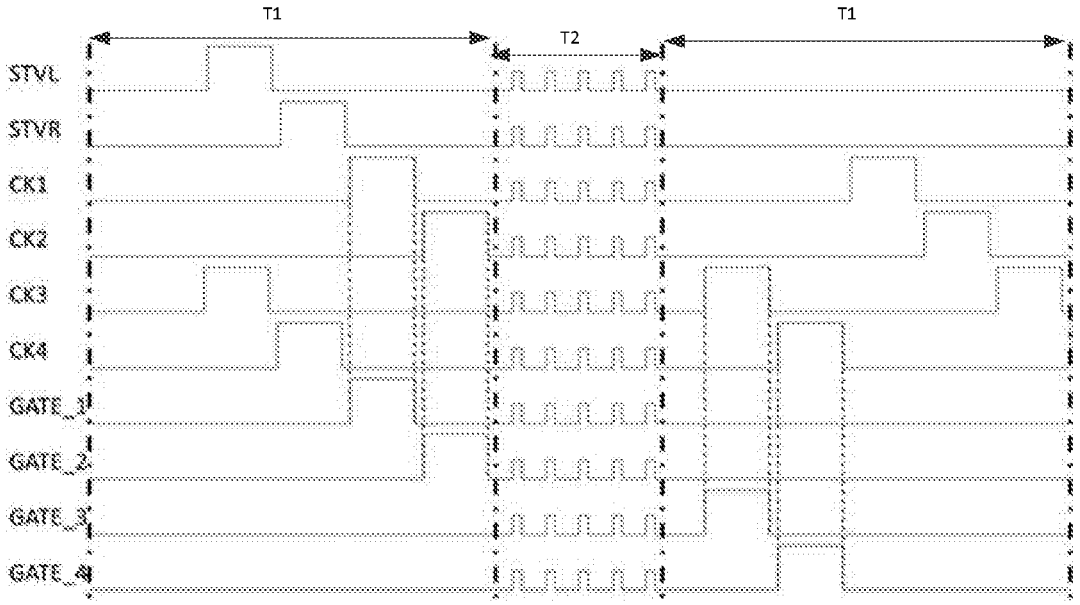
FIG. 4 (PRIOR ART)
FIG. 4 is a sequence diagram of a GOA circuit for an existing display panel configured in a 4CK architecture.

When the display panel is configured in a 4CK architecture, the GOA circuit performs scanning circularly by using two basic units as a minimum repetitive unit. As shown in FIGS. 2 and 3, the GOA unit in an n-th level and the GOA unit in an (N+2)th level may form a GOA repetitive unit. Referring to FIG. 4, there are four clock signals CK, i.e., a first clock signal CK1 to a fourth clock signal CK4, in the GOA circuit. When a clock signal in an n-th level from the GOA unit in the n-th level is a first clock signal CK1, a clock signal in an (n+1)th level from the GOA unit in the n-th level is a second clock signal CK2, and a clock signal in an (n−1)th level from the GOA unit in the n-th level is a fourth clock signal CK4. When a clock signal in an n-th level from the GOA unit in the (n+2)th level is a third clock signal CK3, a clock signal in an (n+1)th level from the GOA unit in the (n+2)th level is a fourth clock signal, and a clock signal in an (n−1)th level from the GOA unit in the (n+2)th level is a second clock signal. It may be understood that, if the second and fourth clock signals are correspondingly supplied to the node signal control module 200 of the GOA unit in the n-th level and the first clock signal is supplied to the output control module 300, the first and third clock signals are supplied to the node signal control module 200 of the GOA unit in the (n+1)th level, and the second clock signal is supplied to the output control module 300. Of course, the display panel may also be configured in a 8CK architecture, and in this case, the GOA circuit performs scanning circularly by using four basic units as a minimum repetitive unit.

FIG. 4 shows a sequence diagram of a GOA circuit corresponding to a display panel configured in a 4CK architecture, where STVL and STVR are activation signals, and both the first global signal GAS1 and the second global signal GAS2 are in a low level when the display panel operates normally. The second global signal GAS2 is converted from a low level in a display term T1 into a high level in a touch term T2.

GATE_1 to GATE_4 represent first to fourth scanning signals, respectively, which correspond to gate driving signals from the GOA circuits in a level 1 to a level 4, respectively.

It may be understood that, if the first clock signal is supplied to the output control module 300 of the GOA unit in a level 1, the second clock signal is supplied to the output control module 300 of the GOA unit in a level 2. Since the third clock signal is supplied to the output control module 300 of the GOA unit in a level 3 and the fourth clock signal is supplied to the output control module 300 of the GOA unit in a level 4, when the CK1 is in a high level, G(1) is in a high level and the GATE_1 is thus in a high level. The remaining GATE_2 and GATE_4 are similar to this situation.

Returning to FIG. 1, during a TP term, a scanning line suspends the input of a scanning signal, that is, a GOA unit corresponding to the scanning line at a suspension suspends the output. In this case, when the G(n−2) and U2D of this GOA unit are in a high level, the node Q is in a high potential. However, although a second thin film transistor NT2 is disconnected, there is still current leakage. As a result, the stability of hierarchical transmission of the GOA circuit is reduced and the operating stability of the GOA units is influenced.

Figure 5:
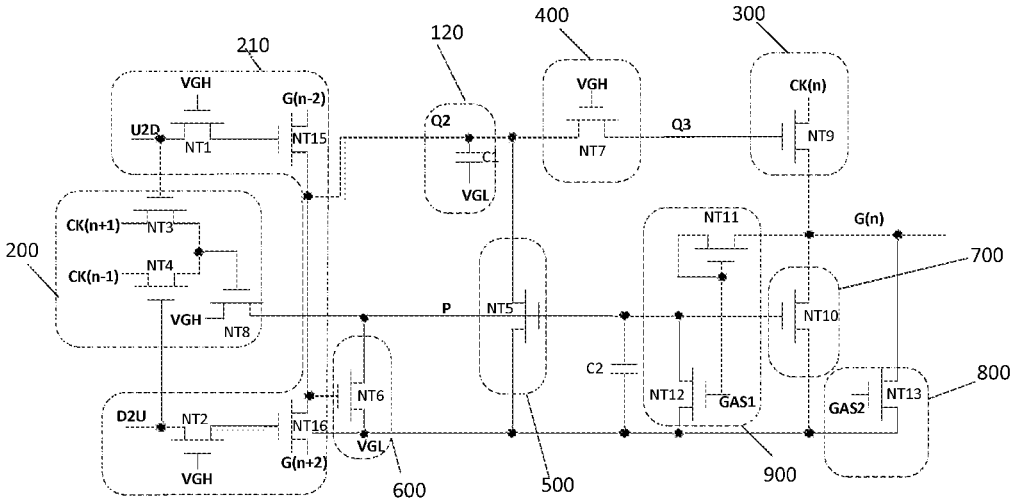
FIG. 5 is a schematic structure diagram of a GOA circuit according to Embodiment 1 of the present disclosure.

Referring to FIG. 5, FIG. 5 is a schematic structure diagram of a GOA circuit according to Embodiment 1 of the present disclosure.

As shown in FIG. 5, the GOA circuit in this embodiment includes m cascaded GOA units; the GOA unit in an n-th level includes a forward/backward scanning control module 210, a node signal control module 200, an output control module 300, a first voltage stabilizer module 400, a first pull-down module 500, a second pull-down module 600, a third pull-down module 700, a second voltage stabilizer module 110 and a charge storage module 120; and, in addition, the GOA unit in the n-th level may further include a second capacitor C2, a fourth pull-down module 800 and a pull-up module 900, where m≥n≥1.

The forward/backward scanning control module 210 is configured to control, according to a forward scanning control signal or a backward scanning control signal, the GOA circuit to perform forward scanning or backward scanning. The level of an output signal from the forward/backward scanning control module 210 (the level corresponding to Q2) is greater than a preset value (the level of the node Q in FIG. 1). In this case, the potential of the node Q2 is equivalent to a sum of the existing potential of the node Q and the potential of G(n−2).

The first voltage stabilizer module 400 is configured to maintain the level of a first node Q2.

The first pull-down module 500 is configured to pull down the level of the first node Q2.

The charge storage module 120 is configured to store charge of the first node Q2.

The functions of the remaining modules are the same as the functions shown in FIG. 1.

The forward/backward scanning control module 210 includes a first thin film transistor NT1, a second thin film transistor NT2, a fifteenth thin film transistor NT15 and a sixteenth thin film transistor NT16.

A constant-voltage high-potential signal VGH is supplied to a gate of the first thin film transistor NT1, a forward DC scanning control signal U2D is supplied to a source of the first thin film transistor NT1, and a drain of the first thin film transistor NT1 is connected to a gate of the fifteenth thin film transistor NT15. A gate driving signal G(n−2) from a GOA structure unit in an (N−2)th level is supplied to a source of the fifteenth thin film transistor NT15, and a drain of the fifteenth thin film transistor NT15 is connected to a drain of the sixteenth thin film transistor NT16, the second pull-down module 600 and the first node Q2, respectively.

A constant-voltage high-potential signal VGH is supplied to a gate of the second thin film transistor NT2, a backward DC scanning control signal D2U is supplied to a source of the second thin film transistor NT2, a drain of the second thin film transistor NT2 is connected to a gate of the sixteenth thin film transistor NT16, and a gate driving signal G(n+2) from a GOA structure unit in an (N+2)th level is supplied to a source of the sixteenth thin film transistor NT16.

The second drop-down module 600 includes a sixth thin film transistor NT6. A gate of the sixth thin film transistor NT6 is connected to the drain of the sixteenth thin film transistor NT16, a constant-voltage low-potential signal VGL is supplied to a source of the sixth thin film transistor NT6, and a drain of the sixth thin film transistor NT6 is connected to the second node P.

The charge storage module 120 includes a first capacitor C1. One end of the first capacitor C1 is connected to the first node Q2, and a constant-voltage low-potential signal VGL is supplied to the other end of the first capacitor C1.

The node signal control module 200 includes a third thin film transistor NT3, a fourth thin film transistor NT4 and an eighth thin film transistor NT8. A forward DC scanning control signal U2D is supplied to a gate of the third thin film transistor NT3, a clock signal in an (n+1)th level is supplied to a source of the third thin film transistor NT3, and a drain of the third thin film transistor NT3 is connected to a drain of the fourth thin film transistor NT4 and a gate of the eighth thin film transistor NT8. A backward DC scanning control signal DU2 is supplied to a gate of the fourth thin film transistor NT4, and a clock signal in an (n−1)th level is supplied to a source of the fourth thin film transistor NT4. A constant-voltage high-potential signal VGH is supplied to a source of the eighth thin film transistor NT8, and a source of the eighth thin film transistor NT8 is connected to the second node P.

The first voltage stabilizer module 400 includes a seventh thin film transistor NT7. A constant-voltage high-potential signal VGH is supplied to a gate of the seventh thin film transistor NT7, a source of the seventh thin film transistor NT7 is connected to the first node Q2, and a drain of the seventh thin film transistor NT7 is connected to a third node Q3.

The first pull-down module 500 includes a fifth thin film transistor NT5. A gate of the fifth thin film transistor NT5 is connected to the second node P, a drain of the fifth thin film transistor NT5 is connected to the first node Q2, and a constant-voltage low-potential signal VGL is supplied to a source of the fifth thin film transistor NT5.

The output control module 300 includes a ninth thin film transistor NT9. A gate of the ninth thin film transistor NT9 is connected to the third node Q3, and a clock signal CK(n) in the current level is supplied to a source of the ninth thin film transistor NT9.

The third pull-down module 700 includes a tenth thin film transistor NT10. A gate of the tenth thin film transistor NT10 is connected to the second node P, and a constant-voltage low-potential signal VGL is supplied to a source of the tenth thin film transistor NT10.

The fourth pull-down module 800 includes a thirteenth thin film transistor NT13. A second global signal GAS2 is supplied to a gate of the thirteen thin film transistor NT13, and a constant-voltage low-potential signal VGL is supplied to a source of the thirteen thin film transistor NT13.

The pull-up module 900 includes an eleventh thin film transistor NT11 and a twelfth thin film transistor NT12. A gate and a source of the eleventh thin film transistor NT11 are connected. A first global signal GAS1 is supplied to a gate of the twelfth thin film transistor NT12 and the gate of the eleventh thin film transistor NT11. A constant-voltage low-potential signal VGL is supplied to a source of the twelfth thin film transistor NT12, and a drain of the twelfth thin film transistor NT12 is connected to the second node. A drain of the eleventh thin film transistor NT11 is connected to the drain of the ninth thin film transistor NT9, the drain of the tenth thin film transistor NT10 and the drain of the thirteenth thin film transistor NT13, respectively.

One end of the second capacitor C2 is connected to the second node P, and a constant-voltage low-potential signal VGL is supplied to the other end of the second capacitor C2.

Figure 6:
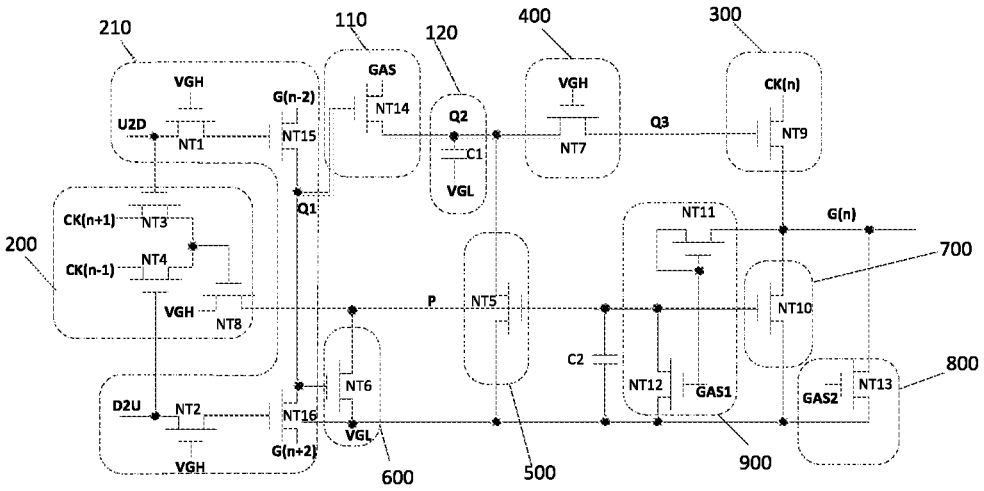
FIG. 6 is a schematic structure diagram of a GOA circuit according to Embodiment 2 of the present disclosure.

Referring to FIG. 6, FIG. 6 is a schematic structure diagram of a GOA circuit according to Embodiment 2 of the present disclosure.

The difference between this embodiment and Embodiment 1 lies in that the GOA unit in the n-th level includes:

a second voltage stabilizer module 110, which is electrically connected to both the forward/backward scanning control module 100 and the second pull-down module 600 and configured to maintain the level of the output signal from the forward/backward scanning control module 100, i.e., maintaining the level of the node Q1.

The second voltage stabilizer module 110 includes a fourteenth thin film transistor NT14. A source of the fourteenth thin film transistor is connected to the forward/backward scanning control module 100. A gate of the fourteenth thin film transistor NT14 is connected to the drain of the fifteenth thin film transistor NT15, a global signal GAS is supplied to a source of the fourteenth thin film transistor NT14, and a drain of the fourteenth thin film transistor NT14 is connected to the first node Q2. When all gates are turned on, the GAS1 is in a high level while the GAS is in a low level. At other moments, the GAS is in a high level.

In addition, the drain of the fifteenth thin film transistor NT15 is connected to the node Q1.

Figure 7:
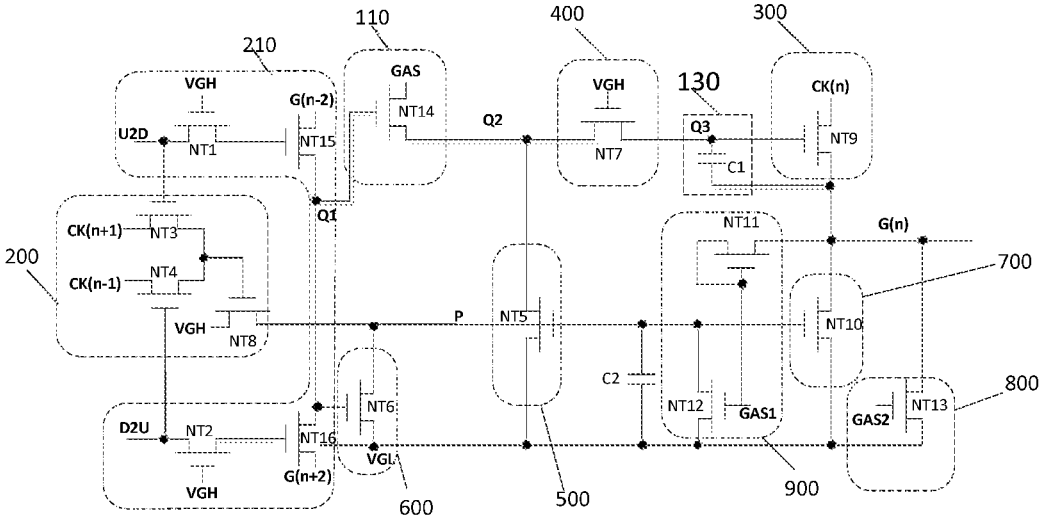
FIG. 7 is a schematic structure diagram of a GOA circuit according to Embodiment 3 of the present disclosure.

Referring to FIG. 7, FIG. 7 is a schematic structure diagram of a GOA circuit according to Embodiment 3 of the present disclosure.

The difference between this embodiment and Embodiment 1 lies in that: the charge storage module 130 is configured to store charge of a third node Q3, wherein the third node Q3 is a connection point between the output control module 300 and the first voltage stabilizer module 400. The charge storage module 130 includes a first capacitor C1. One end of the first capacitor C1 is connected to the third node Q3, while the other end thereof is connected to the drain of the ninth thin film transistor NT9.

Since the position of the first capacitor is changed, it is more advantageous for the rise of the potential at the node Q3 and the output of G(n). For example, the CK1 is in a high level, the NT9 is turned on, and the drain of the NT9 is in a high level, so that the potential at the node Q3 rises again. This embodiment is also applicable to Embodiment 1.

Figure 8:
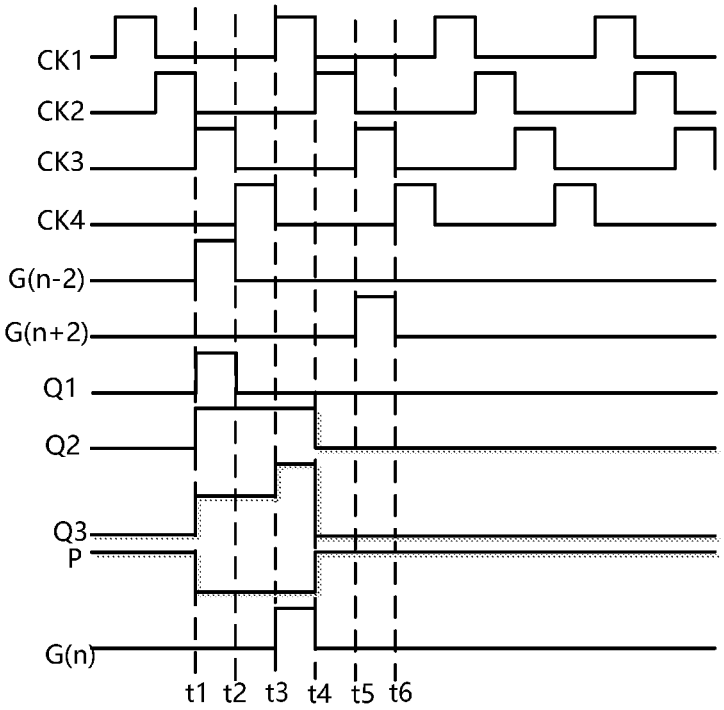
FIG. 8 is a sequence diagram of the GOA circuit shown in FIG. 6 or 7.

As shown in FIG. 8, from t1 to t2, when the G(n−2) is in a high level, Q1, Q2 and Q3 are in a high level; from t2 to t3, when the G(n−2) is in a low level, Q1 is in a low level; and from t3 to t4, the CK1 is in a high level, the NT9 is turned on, and the drain of the NT9 is in a high level, so that the potential at the node Q3 rises again. At a moment t4, a rising edge of the CK2 appears, the NT5 is turned on, and the potential at the node Q2 is pulled down. From t5 to t6, the CK3 is in a high level, and the G(n+2) is in a high level.

In the GOA circuit of the present disclosure, since the forward/backward scanning control module is improved, that is, a fifteenth thin film transistor and a sixteenth thin film transistor are additionally provided, the capability of inputting hierarchical transmission signals into the GOA circuit is improved, and the threshold loss during the hierarchical transmission is avoided. In this case, the potential of the node Q1 is equivalent to a sum of the existing potential of the node Q and the potential of G(n−2). In other words, the level of the output signal from the forward/backward scanning control module is increased.

In addition, in the GOA circuit of the present disclosure, since a second voltage stabilizer module is additionally provided, it is equivalent that the existing node Q is split into two nodes Q1 and Q2. The node Q2 plays a role of hierarchical transmission. Compared with the node Q in FIG. 1, with the node Q2, a leakage path (i.e., NT2) is reduced. Accordingly, the signal at the output end of the forward/backward scanning control module 100 during a touch operation is prevented from leaking through the NT2, and the stability of the potential of the node Q2 is improved. Thus, the requirements on the waveform at the node G(n−2) during the hierarchical transmission of the GOA circuit are reduced, and the stability of hierarchical transmission of the GOA circuit is improved. In addition, a display region of a panel is prevented from influencing the hierarchical transmission of the GOA circuit through the node G(n+2), picture flickering is avoided, and the reliability of hierarchical transmission is improved.

The present disclosure further provides a display panel which includes any one of the aforementioned GOA circuits. The display panel may be a liquid crystal panel.

The present disclosure further provides a display apparatus which includes the aforementioned display panel.

In the GOA circuit, the display panel and the display apparatus of the present disclosure, by improving the forward/backward scanning control module, the capability of inputting hierarchical transmission signals into the GOA circuit is improved and the threshold loss during the hierarchical transmission is avoided.

In conclusion, although the present disclosure has been described with reference to the preferred embodiment thereof, it is apparent to those skilled in the art that a variety of modifications and changes may be made without departing from the scope of the present disclosure which is intended to be defined by the appended claims.

What is claimed is:

1. A GOA circuit, comprising m cascaded GOA units, the GOA unit in an n-th level comprising:

a forward/backward scanning control circuit, a node signal control circuit, an output control circuit, a first voltage stabilizer circuit, a first pull-down circuit, a second pull-down circuit and a third pull-down circuit, where m≥n≥1;

the forward/backward scanning control circuit is configured to control, according to a forward scanning control signal or a backward scanning control signal, the GOA circuit to perform forward scanning or backward scanning, the level of an output signal from the forward/backward scanning control circuit being greater than a preset value;

the node signal control circuit is configured to control, according to a clock signal in an (n+1)th level and a clock signal in an (n−1)th level, the GOA circuit to output a low-potential gate driving signal in a non-operating stage;

the output control circuit is configured to control, according to a clock signal in a current level, the output of a gate driving signal in the current level;

the first voltage stabilizer circuit is configured to maintain the level of a first node;

the first pull-down circuit is configured to pull down the level of the first node;

the second pull-down circuit is configured to pull down the level of a second node; and the third pull-down circuit is configured to pull down the level of the gate driving signal in the current level, and includes a tenth thin film transistor having a gate connected to the second node, a constant-voltage low-potential signal being supplied to a source of the tenth thin film transistor;

wherein the forward scanning control circuit includes a first thin film transistor, a second thin film transistor, a fifteenth thin film transistor and a sixteenth thin film transistor;

a constant-voltage high-potential signal is supplied to a gate of the first thin film transistor, a forward DC scanning control signal is supplied to a source of the first thin film transistor, and a drain of the first thin film transistor is connected to a gate of the fifteenth thin film transistor; and, a gate driving signal from a GOA structure unit in an (N−2)th level is supplied to a source of the fifteenth thin film transistor, and a drain of the fifteenth thin film transistor is connected to a drain of the sixteenth thin film transistor, the second pull-down circuit and the first node, respectively; and a constant-voltage high-potential signal is supplied to a gate of the second thin film transistor, a backward DC scanning control signal is supplied to a source of the second thin film transistor, and a drain of the second thin film transistor is connected to a gate of the sixteenth thin film transistor; and, a gate driving signal from a GOA structure unit in an (N+2)th level is supplied to a source of the sixteenth thin film transistor.

2. The GOA circuit according to claim 1, wherein:

the GOA unit in the n-th level further comprises:

a second voltage stabilizer circuit, which is electrically connected to the forward/backward scanning control circuit and configured to maintain the level of the output signal from the forward/backward scanning control circuit.

3. The GOA circuit according to claim 2, wherein:

the second voltage stabilizer circuit comprises a fourteenth thin film transistor, a gate of the fourteenth thin film transistor is connected to the drain of the fifteenth thin film transistor, a global signal is supplied to a source of the fourteenth thin film transistor, and a drain of the fourteenth thin film transistor is connected to the first node.

4. The GOA circuit according to claim 1, wherein:

the second pull-down circuit comprises a sixth thin film transistor, a gate of the sixth thin film transistor is connected to the drain of the sixteenth thin film transistor, the constant-voltage low-potential signal is supplied to a source of the sixth thin film transistor, and a drain of the sixth thin film transistor is connected to the second node.

5. The GOA circuit according to claim 1, wherein:

the GOA unit in the n-th level further comprises a charge storage circuit configured to store charge of a third node, wherein the third node is a connection point between the output control circuit and the first voltage stabilizer circuit.

6. The GOA circuit according to claim 5, wherein:

the charge storage circuit comprises a first capacitor, one end of which is connected to the third node and the other end of which is connected to an output end of the output control circuit.

7. The GOA circuit according to claim 6, wherein:

the output control circuit comprises a ninth thin film transistor, a gate of the ninth thin film transistor is connected to the third node, a clock signal in a current level is supplied to a source of the ninth thin film transistor, and a drain of the ninth thin film transistor is connected to the third pull-down circuit and the other end of the first capacitor, respectively.

8. The GOA circuit according to claim 7, wherein:

the GOA unit in the n-th level further comprises a fourth pull-down circuit and a pull-up circuit;

the fourth pull-down circuit comprises a thirteenth thin film transistor, a second global signal is supplied to a gate of the thirteenth thin film transistor and the constant-voltage low-potential signal is supplied to a source of the thirteenth thin film transistor; and the pull-up circuit comprises an eleventh thin film transistor and a twelfth thin film transistor; a gate and a source of the eleventh thin film transistor are connected; a first global signal is supplied to a gate of the twelfth thin film transistor and the gate of the eleventh thin film transistor; a constant-voltage low-potential signal is supplied to a source of the twelfth thin film transistor, and a drain of the twelfth thin film transistor is connected to the second node; a drain of the eleventh thin film transistor is connected to the drain of the ninth thin film transistor, a drain of the tenth thin film transistor and a drain of the thirteenth thin film transistor.

9. The GOA circuit according to claim 1, wherein:

the first pull-down circuit comprises a fifth thin film transistor having a gate connected to the second node; and a drain of the fifth thin film transistor is connected to the first node, and the constant-voltage low-potential signal is supplied to a source of the fifth thin film transistor.

10. A liquid crystal panel, comprising a GOA circuit that includes m cascaded GOA units, wherein the GOA unit in an n-th level comprises:

a forward/backward scanning control circuit, a node signal control circuit, an output control circuit, a first voltage stabilizer circuit, a second voltage stabilizer circuit, a first pull-down circuit, a second pull-down circuit and a third pull-down circuit, where m≥n≥1;

the forward/backward scanning control circuit is configured to control, according to a forward scanning control signal or a backward scanning control signal, the GOA circuit to perform forward scanning or backward scanning, the level of an output signal from the forward/backward scanning control circuit being greater than a preset value;

the node signal control circuit is configured to control, according to a clock signal in an (n+1)th level and a clock signal in an (n−1)th level, the GOA circuit to output a low-potential gate driving signal in a non-operating stage;

the output control circuit is configured to control, according to a clock signal in a current level, the output of a gate driving signal in the current level;

the first voltage stabilizer circuit is configured to maintain the level of a first node;

the second voltage stabilizer circuit is electrically connected to the forward/backward scanning control circuit and configured to maintain the level of the output signal from the forward/backward scanning control circuit;

the first pull-down circuit is configured to pull down the level of the first node;

the second pull-down circuit is configured to pull down the level of a second node; and the third pull-down circuit is configured to pull down the level of the gate driving signal in the current level.

11. The liquid crystal panel according to claim 10, wherein the forward scanning control circuit includes a first thin film transistor, a second thin film transistor, a fifteenth thin film transistor and a sixteenth thin film transistor;

a constant-voltage high-potential signal is supplied to a gate of the first thin film transistor, a forward DC scanning control signal is supplied to a source of the first thin film transistor, and a drain of the first thin film transistor is connected to a gate of the fifteenth thin film transistor; and, a gate driving signal from a GOA structure unit in an (N−2)th level is supplied to a source of the fifteenth thin film transistor, and a drain of the fifteenth thin film transistor is connected to a drain of the sixteenth thin film transistor, the second pull-down circuit and the first node, respectively; and a constant-voltage high-potential signal is supplied to a gate of the second thin film transistor, a backward DC scanning control signal is supplied to a source of the second thin film transistor, and a drain of the second thin film transistor is connected to a gate of the sixteenth thin film transistor; and, a gate driving signal from a GOA structure unit in an (N+2)th level is supplied to a source of the sixteenth thin film transistor.

12. The liquid crystal panel according to claim 11, wherein the second voltage stabilizer circuit comprises a fourteenth thin film transistor, a gate of the fourteenth thin film transistor is connected to the drain of the fifteenth thin film transistor, a global signal is supplied to a source of the fourteenth thin film transistor, and a drain of the fourteenth thin film transistor is connected to the first node.

13. The liquid crystal panel according to claim 11, wherein the second pull-down circuit comprises a sixth thin film transistor, a gate of the sixth thin film transistor is connected to the drain of the sixteenth thin film transistor, the constant-voltage low-potential signal is supplied to a source of the sixth thin film transistor, and a drain of the sixth thin film transistor is connected to the second node.

14. The liquid crystal panel according to claim 10, wherein the GOA unit in the n-th level further comprises a charge storage circuit configured to store charge of a third node, wherein the third node is a connection point between the output control circuit and the first voltage stabilizer circuit.

15. The liquid crystal panel according to claim 14, wherein the charge storage circuit comprises a first capacitor, one end of which is connected to the third node and the other end of which is connected to an output end of the output control circuit.

16. The liquid crystal panel according to claim 15, wherein the output control circuit comprises a ninth thin film transistor, a gate of the ninth thin film transistor is connected to the third node, a clock signal in a current level is supplied to a source of the ninth thin film transistor, and a drain of the ninth thin film transistor is connected to the third pull-down circuit and the other end of the first capacitor, respectively.

17. The liquid crystal panel according to claim 10, wherein the third pull-down circuit includes a tenth thin film transistor having a gate connected to the second node, a constant-voltage low-potential signal being supplied to a source of the tenth thin film transistor.

18. The liquid crystal panel according to claim 10, wherein the GOA unit in the n-th level further comprises a second capacitor, one end of the second capacitor is connected to the second node, and a constant-voltage low-potential signal is supplied to the other end of the second capacitor.

19. A display apparatus, comprising a liquid crystal panel that has a GOA circuit, wherein the GOA circuit comprises m cascaded GOA units, and the GOA unit in an n-th level comprises:

a forward/backward scanning control circuit, a node signal control circuit, an output control circuit, a first voltage stabilizer circuit, a second voltage stabilizer circuit, a first pull-down circuit, a second pull-down circuit and a third pull-down circuit, where $m \geq n \geq 1$;

the forward/backward scanning control circuit is configured to control, according to a forward scanning control signal or a backward scanning control signal, the GOA circuit to perform forward scanning or backward scanning, the level of an output signal from the forward/backward scanning control circuit being greater than a preset value;

the node signal control circuit is configured to control, according to a clock signal in an (n+1)th level and a clock signal in an (n−1)th level, the GOA circuit to output a low-potential gate driving signal in a non-operating stage;

the output control circuit is configured to control, according to a clock signal in a current level, the output of a gate driving signal in the current level;

the first voltage stabilizer circuit is configured to maintain the level of a first node;

the second voltage stabilizer circuit comprises a fourteenth thin film transistor, a gate of the fourteenth thin film transistor is connected to an output end of the forward/backward scanning control circuit, a global signal is supplied to a source of the fourteenth thin film transistor, and a drain of the fourteenth thin film transistor is connected to the first node;

the first pull-down circuit is configured to pull down the level of the first node;

the second pull-down circuit is configured to pull down the level of a second node; and the third pull-down circuit is configured to pull down the level of the gate driving signal in the current level.

* * * * *